US007559961B2

(12) United States Patent
Jimeson et al.

(10) Patent No.: US 7,559,961 B2
(45) Date of Patent: Jul. 14, 2009

(54) MIXED ALCOHOL FUELS FOR INTERNAL COMBUSTION ENGINES, FURNACES, BOILERS, KILNS AND GASIFIERS

(75) Inventors: Robert M. Jimeson, Vienna, VA (US); Mark C. Radosevich, Durango, CO (US); Rex R. Stevens, Grand Junction, CO (US)

(73) Assignee: Standard Alcohol Company of America, Inc., Durango, CO (US)

( * ) Notice: Subject to any disclaimer, the term of this patent is extended or adjusted under 35 U.S.C. 154(b) by 905 days.

(21) Appl. No.: 11/060,169

(22) Filed: Feb. 17, 2005

(65) Prior Publication Data

US 2005/0144834 A1 Jul. 7, 2005

Related U.S. Application Data

(63) Continuation-in-part of application No. 10/124,665, filed on Apr. 17, 2002, now Pat. No. 6,858,048.

(60) Provisional application No. 60/284,619, filed on Apr. 18, 2001, provisional application No. 60/284,620, filed on Apr. 18, 2001, provisional application No. 60/284,621, filed on Apr. 18, 2001.

(51) Int. Cl.
*C10L 1/10* (2006.01)
*C10L 1/18* (2006.01)

(52) U.S. Cl. ..... 44/452; 44/266; 44/280

(58) Field of Classification Search ..... 44/280, 44/452, 266

See application file for complete search history.

(56) References Cited

U.S. PATENT DOCUMENTS

| | | | | |
|---|---|---|---|---|
| 2,128,910 | A | 9/1938 | Bludworth | |
| 3,822,119 | A | 7/1974 | Frech | |
| 3,968,999 | A | 7/1976 | Keller | |
| 4,018,293 | A | 4/1977 | Keller | |
| 4,030,893 | A | 6/1977 | Keller | |
| 4,045,092 | A | 8/1977 | Keller | |
| 4,089,657 | A | 5/1978 | Keller | |
| 4,097,217 | A | 6/1978 | Keller | |
| 4,146,366 | A | 3/1979 | Keller | |
| 4,192,651 | A | 3/1980 | Keller | |
| 4,218,516 | A | 8/1980 | Meyer et al. | |
| 4,298,354 | A | 11/1981 | Hardman et al. | |
| 4,357,146 | A | 11/1982 | Heeren | |
| 4,366,032 | A * | 12/1982 | Mikitenko et al. | 203/18 |
| 4,384,872 | A | 5/1983 | Kester et al. | |
| 4,479,807 | A | 10/1984 | Rebandt | |
| 4,533,508 | A | 8/1985 | Stevens | |
| 4,561,861 | A | 12/1985 | Davis et al. | |
| 4,675,344 | A | 6/1987 | Conway et al. | |
| 4,705,532 | A | 11/1987 | Mazanec et al. | |
| 4,752,622 | A | 6/1988 | Stevens | |
| 4,752,623 | A | 6/1988 | Stevens | |
| 4,762,858 | A | 8/1988 | Hucul et al. | |
| 4,825,013 | A | 4/1989 | Quarderer et al. | |
| 4,831,060 | A | 5/1989 | Stevens et al. | |
| 4,871,397 | A | 10/1989 | Stevens | |
| 4,882,360 | A | 11/1989 | Stevens | |
| 4,895,662 | A | 1/1990 | Stevens | |
| 4,953,479 | A | 9/1990 | Keller et al. | |
| RE33,562 | E | 4/1991 | Badger | |
| 5,045,087 | A | 9/1991 | Keller | |
| 5,288,393 | A | 2/1994 | Jessup et al. | |
| 5,559,275 | A | 9/1996 | Barger | |
| 5,653,866 | A | 8/1997 | Jessup et al. | |
| 5,663,455 | A | 9/1997 | Harris et al. | |
| 5,837,126 | A | 11/1998 | Jessup et al. | |
| 6,030,521 | A | 2/2000 | Jessup et al. | |
| 6,039,772 | A | 3/2000 | Orr | |

FOREIGN PATENT DOCUMENTS

| | | |
|---|---|---|
| CN | 1089299 | 7/1994 |

OTHER PUBLICATIONS

"The Economical Production of Alcohol Fuels from Coal-Derived Synthesis Gas", Quarterly Technical Progress Report No. 18, West Virginia University Research Corporation, Apr. 1996, 15 pages.

"Dow Develops Catalytic Method to Produce Higher Mixed Alcohols", Technology, Nov. 12, 1984, pp. 29-30.

"Mixed Alcohols from Synthesis Gas", Dow Chemical, M.J. Mintz and G.J. Quarderer, pp. 1-21, no date.

"Evaluation of Synthesis Gas Based High Octane Oxygenates" (The Mixed Alcohols Option), Abdel Elsawy and David Gray, Nov. 1988, pp. 119-136.

Letter and enclosures from Lurgi GMBH to Wayne Kreis of The Texas Methanol Corporation, dated Jan. 19, 1987, ref: Octamix-Sample Shipment of January 17, 1987, Frankfurt, Germany, 3 pages.

* cited by examiner

*Primary Examiner*—Cephia D Toomer
(74) *Attorney, Agent, or Firm*—Geoffrey A. Mantooth

(57) ABSTRACT

Mixed alcohol formulas can be used as a fuel additive in gasoline, diesel, jet fuel, aviation gasoline, heating oil, bunker oil, coal, petroleum coke or as a neat fuel in and of itself. The mixed alcohols formulations can contain $C_1$-$C_5$ alcohols, or in the alternative, $C_1$-$C_8$ alcohols or higher $C_1$-$C_{10}$ alcohols in order to boost energy content. The $C_1$-$C_5$ mixed alcohols contain more ethanol than methanol with declining amounts of propanol, butanol and pentanol. $C_1$-$C_8$ mixed alcohols contain the same, with declining amounts of hexanol, heptanol and octanol. $C_1$-$C_{10}$ mixed alcohols contain the same, with declining amounts of nananol and decanol. Synthetically produced mixed alcohol formulas feature higher octane and energy densities than either MTBE or fermented grain ethanol; more stable Reid Vapor Pressure blending characteristics; and increased soluablizing effects on condensate water. The primary benefits of mixed alcohols are increased combustion efficiencies, reduced emissions profiles and low production costs.

12 Claims, No Drawings

MIXED ALCOHOL FUELS FOR INTERNAL COMBUSTION ENGINES, FURNACES, BOILERS, KILNS AND GASIFIERS

This application claims the benefit of U.S. provisional patent applications 60/284,619; 60/284,620 and 60/284,621, all filed on Apr. 18, 2001, and is a continuation-in-part of application Ser. No. 10/124,665, filed Apr. 17, 2002, which is now U.S. Pat. No. 6,858,048.

FIELD OF THE INVENTION

The present invention relates to mixed alcohol fuels used in internal combustion engines, furnaces and boilers, and in particular blended into gasoline fuels, diesel fuels, jet fuels, heating oil fuels, bunker oil fuels, petroleum coke and coal.

BACKGROUND OF THE INVENTION

Internal combustion engines are commonly used on mobile platforms (to propel vehicles such as cars, trucks, airplanes, motorcycles, jet skis, snowmobiles), in remote areas (such as for oil well pumps or electric generators) or in lawn and garden tools (such as lawnmowers, weed-eaters, chainsaws, etc.). There are various types of internal combustion engines, furnaces, boilers, kilns and gasifiers.

Spark type engines utilize a volatile fuel, such as gasoline. A spark plug provides the source of ignition. A typical fuel is gasoline, or in high performance engines, methanol. Compression type engines take in air and compress it to generate the heat necessary to ignite the fuel. Typical compression engines also utilize diesel fuel.

When gasoline is burned, it produces pollutants in the form of hydrocarbons (HC), nitrogen oxides (NOx), carbon monoxide (CO) and soot (particulates). In addition, gasoline in warm climates tends to evaporate due to the presence of volatile organic compounds (VOCs).

Internal combustion diesel engines are commonly used in vehicles. Furnaces and boilers are typically used for home or space heating, electrical generation or propulsion of large ships. Kilns are drying devices. Smaller kilns are used in the manufacture of pottery and ceramics. Larger kilns are used to dry lumber or manufacture cement. Gasifiers are devices which convert solid carbonaceous fuels into CO & $H_2$ synthesis gas which is either combusted or further catalyzed into liquid products.

When diesel, lower distillates, petroleum coke or coal is combusted, these fossils produce pollutants in the form of hydrocarbons (HC), nitrogen oxides (NOx), carbon monoxide (CO) and soot (particulates). Nitrogen oxides and volatile organic components react together in sunlight to form ground level ozone, a component of smog. Diesel has less of a tendency to evaporate than does gasoline. Lower distillate heating oils, bunker oils, coke or coal have even less tendency to evaporate VOC's.

In areas of high use, such as heavy automobile traffic, exhaust emissions from internal combustion engines, furnaces, boilers or kilns plus evaporation from the fuel tanks result in significant air pollution. In some urban areas, a brown haze of pollution frequently hugs the first several hundred feet off of the ground.

Alcohol fuel additives have come into use for internal combustion engines as an oxygenate in order to reduce harmful emissions. In the 1970's, gasohol, a blend of mostly gasoline with some ethanol, was introduced during the Arab oil embargo to extend supplies of gasoline. Unfortunately, at that time, many of the elastomeric engine seals, hoses and gasket components were designed only for gasoline or diesel and deteriorated with the use of ethanol. Since then, engines have become equipped with fluorinated elastomers, which are tolerant to alcohol fuel.

Today, the primary alcohol fuel is ethanol, which is typically fermented from grain (corn, wheat, barley, oats, sugar beets, etc.) in a fermentation process. The ethanol is blended into gasoline in various quantities. "Premium" gasoline, with a higher (Research Octane+Motor Octane)/2 (also known as (R+M)/2) octane rating than "regular" gasoline, is primarily gasoline with 10% ethanol ($C_2$ alcohol). Another ethanol fuel is E-85, which is 85% ethanol and 15% gasoline. Still another alcohol fuel is M-85, which is 85% methanol ($C_1$ alcohol) and 15% gasoline.

Grain ethanol is expensive to produce. Furthermore, producing sufficient quantities of grain ethanol to satisfy the needs of the transportation industry is not practical because food crops are diverted into fuel. Traditionally, grain ethanol has been heavily subsidized by governments. Droughts and government policy towards farming in general (less intervention and payments to farmers) make the supply of grain ethanol uncertain and expensive.

In addition, both methanol and ethanol have a relatively lower energy content when compared to gasoline. Methanol contains about 50,000 Btu's/gallon and ethanol contains about 76,000 Btu's/gallon while gasoline contains about 113,000 Btu's/gal. A motorist notices this when a vehicle running on gasoline achieves more miles per gallon than does a similar vehicle running on alcohol fuels.

Some time ago, lead was added to gasoline to boost its octane rating. The octane rating relates to antiknock properties of gasoline. Lead is being eliminated from gasoline for environmental reasons. For the past twenty years or so, gasoline sold in the United States and many other countries has been blended with 5-15% volumes of methyl-tertiary-butyl-ether (MTBE), an oxygenate, in order to raise the octane rating and to reduce environmentally harmful exhaust emissions.

Unfortunately, MTBE is itself a pollutant, having an objectionable odor and taste and having been classified as a potential human carcinogen. To make matters worse, many gasoline storage tanks have developed leaks. MTBE is highly soluble in water and is low in biodegradability. MTBE features a tertiary carbon bond in its molecule which is difficult for natural organisms, such as bacteria or phytoplankton to break down. Consequently, MTBE has polluted the ground water in many communities. Several U.S. states, including Calif., are phasing out the use of MTBE. This phase out will likely result in an eventual ban of MTBE in the USA and in other countries.

The presently planned replacement for MTBE is fermented grain ethanol, but as discussed above, producing the necessary quantities of grain ethanol to replace MTBE will be problematic in specific regions.

Therefore an effective replacement for MTBE in gasoline is needed. In addition, a fuel is needed to reduce harmful combustion emissions from diesel fuel, jet fuel, lower distillate petroleum fuels, coke and coal to reduce particulate soot, hydrocarbons and carbon monoxide. Furthermore, larger quantities of a higher energy content alcohol fuel are needed than can be produced from grain fermentation for the production of ethanol.

MMT, Methylcyclopentadienyl Manganese Tricarbonyl, has been a controversial gasoline additive for many years. MMT was initially used by refiners in the 1970's chiefly to increase octane but studies have shown that while increasing octane, MMT increases emissions, fouls spark plugs and emission control systems. MMT like MTBE usage is declining in North America and in other developed countries. Mixed alcohols can substitute for the octane increase of MMT while additionally working as an oxygenate to improve combustion efficiency which reduces exhaust emissions.

SUMMARY OF THE INVENTION

It is an object of the present invention to provide a gasoline fuel blend stock that can be used as a substitute for MTBE, grain ethanol, MMT and other octane boosters.

It is another object of the present invention to provide a gasoline fuel that has reduced emissions of regulated pollutants.

It is another object of the present invention to provide a gasoline fuel blend stock that raises the octane number of the blended gasoline.

It is another object of the present invention to provide a gasoline fuel blend stock that reduces the need for lead in aviation gasoline.

It is another object of the present invention to provide a gasoline fuel blend stock that features a low to mid-range Reid Vapor Pressure.

It is another object of the present invention to provide a gasoline fuel blend stock that features a Btu energy content closer to the energy content of gasoline alone.

It is an object of the present invention to provide a diesel fuel that produces less soot when combusted.

It is another object of the present invention to provide a diesel fuel that has fewer harmful emissions when combusted.

It is an object of the present invention to provide a less expensive and stronger Btu alcohol fuel which reduces land and water pollution.

It is another object of the present invention to provide a neat alcohol fuel that features an energy content nearer to that of gasoline.

The present invention provides a fuel for use in internal combustion engines, comprising gasoline and a mixture of alcohols. The mixture of alcohols comprises by volume 1-30% methanol, 40-75% ethanol, 10-20% propanol, 4-10% butanol and 1-8% pentanol.

The gasoline fuel need not contain MTBE as a source of oxygen. Instead, the mixed alcohols serve as an oxygenate to provide for increased combustion efficiency thereby reducing emissions. The mixed alcohols are water soluble and are biodegradable. Thus, the mixed alcohols are safer for land and water environments than is MTBE.

In one aspect of the present invention, 10% volume blends of the mixed alcohols increases the octane of 87 octane regular gasoline to an octane number greater than 90. This eliminates or reduces the need to blend in benzene, a carcinogen, or other aromatics, to boost the octane. In some volumetric proportions, the blended octane number can be increased to 100 or greater. Thus, the mixed alcohol-blended gasoline fuel can be used as aviation gasoline without the need for harmful tetraethyl or tetramethyl lead additives.

In another aspect of the present invention, the mixture of alcohols comprises 5-30% of the blended petroleum distillate fuel by volume.

In another aspect of the present invention, the mixture of alcohols, by volume, further comprises 1-6% hexanol, 0.1-6% heptanol and 0.1-6% octanol.

In accordance with another aspect of the present invention the mixed alcohols further comprise, by volume, 0.1-3% nananol and 0.1-3% decanol.

The present invention provides a fuel for use in diesel engines comprising diesel and mixed alcohols. The mixed alcohols comprise, by volume, 1-30% methanol, 40-75% ethanol, 10-20% propanol, 3-10% butanol and 1-8% pentanol.

The use of mixed alcohols in combination with diesel reduces the soot given off during combustion.

In accordance with another aspect of the present invention, the mixed alcohols comprises 5-20%, by volume, of the blended diesel fuel.

In accordance with another aspect of the present invention, the mixed alcohols further comprise, by volume, 1-6% hexanol, 0.1-6% heptanol and 0.1-6% octanol.

In accordance with another aspect of the present invention the mixed alcohols further comprise, by volume, 0.1-3% nananol and 0.1-3% decanol.

The present invention provides a mixed alcohol fuel for use in an internal combustion engine. The mixed alcohol fuel comprises, by volume, 1-30% methanol, 40-75% ethanol, 10-20% propanol, 3-10% butanol and 1-8% pentanol.

The mixed alcohol fuel can be used neat, that is without additions of gasoline, diesel, jet fuel, lower distillate oils or petroleum cokes or coals in an internal combustion engine, furnace or boiler. The mixed alcohol fuel is water soluble and biodegradable. Consequently, it is non-polluting both to water and land environments. In addition, the mixed alcohol fuel can be synthesized from a variety of renewable and non-renewable waste materials utilized as process feedstocks.

In accordance with one embodiment, the mixed alcohol fuel further comprises, by volume: 1-6% hexanol, 0.1-6% heptanol and 0.1-6% octanol.

The use of the higher alcohols, hexanol, heptanol, octanol, and so on increases the Btu energy content of the mixed alcohol fuel such that the mixed alcohol fuel has an energy content nearer to that of gasoline.

In accordance with another aspect of the present invention the mixed alcohols further comprise, by volume, 0.1-3% nananol and 0.1-3% decanol.

The present invention also provides a mixed alcohol fuel for use in an internal combustion engine comprising 20-30% methanol, 40-50% ethanol, 10-20% propanol, 3-8% butanol and 1-8% pentanol.

The present invention provides a jet fuel for use in a jet turbine engine, comprising kerosene and a mixture of alcohols. The mixture of alcohols comprises by volume 1-30% methanol, 40-75% ethanol, 10-20% propanol, 4-10% butanol and 1-8% pentanol.

In another aspect of the present invention, the mixture of alcohols by volume, further comprises 1-6% hexanol, 0.1-6% heptanol and 0.1-6% octanol.

In accordance with another aspect of the present invention the mixed alcohols further comprise, by volume, 0.1-3% nananol and 0.1-3% decanol.

The present invention also provides a fuel for use in heating that comprises heating oils and mixed alcohols. The mixed alcohols comprise, by volume, 1-30% methanol, 40-75% ethanol, 10-20% propanol, 3-10% butanol and 1-8% pentanol.

In accordance with one aspect of the present invention the mixed alcohols further comprise, by volume, 1-6% hexanol, 0.1-6% heptanol and 0.1-6% octanol.

In accordance with another aspect of the present invention the mixed alcohols further comprise, by volume, 0.1-3% nananol and 0.1-3% decanol.

The present invention also provides a fuel for use in marine vessels comprising bunker oil and mixed alcohols. The mixed alcohols comprise, by volume, 1-30% methanol, 40-75% ethanol, 10-20% propanol, 3-10% butanol and 1-8% pentanol.

In accordance with one aspect of the present invention the mixture of alcohols further comprises, by volume, 1-6% hexanol, 0.1-6% heptanol and 0.1-6% octanol.

In accordance with a further aspect of the present invention the mixed alcohols further comprise, by volume, 0.1-3% nananol and 0.1-3% decanol.

It is an object of the present invention to provide improved combustion properties of heating oils and bunker oils.

The present invention also provides a petroleum coke-alcohol fuel used for combustion in furnaces and boilers or gasifiers, by blending petroleum coke particles and mixed alcohols comprising by volume 1-30% methanol, 40-75% ethanol, 10-20% propanol, 3-10% butanol and 1-8% pentanol.

It is an object of the present invention to provide improved transportation and combustion properties of petroleum coke or coal.

It is an object of the present invention to provide a highly efficient and freeze-proof fuel for transportation by pipeline, rail, barge, tanker or ship.

It is an object of the present invention to reduce NOx emissions by lowering combustion temperatures of petroleum coke and coal.

It is an object of the present invention to provide cleaner fuels than conventional fossil fuels featuring higher combustion efficiencies with lower environmental impact per unit of power output.

It is an object of the present invention to conserve or replace water used for the transportation of petroleum coke and coal.

It is an object of the present invention to provide a higher energy content fuel with less sulfur, nitrogen and particulate matter polluting air, water and land environments.

It is an object of the present invention to more efficiently provide the transport of petroleum coke-alcohol or coal-alcohol by suspension slurry to electrical generation plants, gasifiers or tanker, shipping or barge transport facilities.

It is an object of the present invention to beneficiate petroleum coke and coal thus reducing combustion emissions of $NO_x$, $SO_2$ and $H_2SO_4$, which are precursors to acid rain.

In accordance with one aspect of the present invention, the mixture of alcohols by volume, further comprises 1-6% hexanol, 0.1-6% heptanol and 0.1-6% octanol.

In accordance with another aspect of the present invention, the mixed alcohols further comprises by volume 0.1-3% nananol and 0.1-3% decanol.

The present invention also provides a coal-alcohol fuel used for combustion in furnaces, boilers or gasifiers by blending coal particles and mixed alcohols comprising by volume 1-30% methanol, 40-75% ethanol, 10-20% propanol, 3-10% butanol and 1-8% pentanol.

In accordance with one aspect of the present invention, the mixture of alcohols by volume, further comprises 1-6% hexanol, 0.1-6% heptanol and 0.1-6% octanol.

In accordance with another aspect of the present invention, the mixed alcohols further comprises by volume 0.1-3% nananol and 0.1-3% decanol.

DESCRIPTION OF THE PREFERRED EMBODIMENTS

The present invention provides mixed alcohols that can be used as an additive to gasoline-based fuels, diesel-based fuels or jet fuels in internal combustion engines. In addition, the mixed alcohols can be used as "neat," that is without blending into gasoline, diesel or jet fuel.

When used as an additive to gasoline-based fuels, the mixed alcohols can be used as a substitute for MTBE, MMT, lead and/or for grain ethanol as an octane booster. The gasoline-based fuel is gasoline and mixed alcohols. The mixed alcohols also function as an oxygenate providing increased combustion efficiency. The mixed alcohols also function to minimize water contamination of fuels. The mixed alcohol fuel, when combusted in an internal combustion engine, reduces hydrocarbon and carbon monoxide emissions, while having an increased octane number and a more stabilized Reid Vapor Pressure. In addition, carbon deposits on the intake valves, exhaust valves and the combustion chambers of the engines, furnaces and combustion boilers are significantly reduced.

When used as an additive to diesel-based fuels, the mixed alcohols function as an oxygenate. The present invention provides a diesel-based fuel that can be used in internal combustion engines. The diesel-based fuel is diesel and mixed alcohols. The fuel, when combusted in an internal combustion engine, reduces exhaust emissions. A unique property of mixed alcohols is that these longer-chained alcohols as a volumetric blend will solubilize with and enhance the combustion efficiencies of both liquid and solid hydrocarbon-based fuels.

When the mixed alcohols are used "neat," without gasoline or diesel, the internal combustion engine has reduced tailpipe emissions.

The mixed alcohols fuels can be used in a variety of internal combustion engines in automobiles, trucks, motorcycles, aircraft, stationary turbines and smaller engines such as those used in lawnmowers, jet skis, snowmobiles and hand-held tools such as chainsaws or weed-eaters.

Currently the ethanol based fuel E-85 is used in flexible fuel vehicles (FFV). The mixed alcohol fuels can be used in such FFV vehicles. Slight tuning or adjustment of the engine may provide extra power and even lower emission profiles.

The mixed alcohols contain single-chained, molecular alcohols having different numbers of carbon atoms. There are various types of alcohols, which are classified according to the number of carbon atoms. For example, methanol ($C_1$) has one carbon atom, ethanol ($C_2$) has two carbon atoms, n-propanol ($C_3$) has three carbon atoms and so on. The alcohols are, preferably normal and are designated n-propanol, n-butanol, n-pentanol, etc. Although the present invention discusses normal straight-chain alcohols, iso-alcohols could be used as well.

The mixed alcohols of the present invention comprise a number of alcohols. Typically, methanol and ethanol together comprise over 50%, by volume of the mixed alcohols, with other higher alcohols and small amounts of non-alcohol components making up the remainder. A typical mixture of mixed alcohols is, by volume:

1-30% methanol 40-75% ethanol 10-20% propanol 4-10% butanol 1-8% pentanol 1-6% hexanol 0.1-6% heptanol 0.1-6% octanol 0.1-3% nananol 0.1-3% decanol.

Typically, the amount of ethanol exceeds the amount of methanol. In fact, the mixed alcohols may contain the highest proportion of ethanol, with the other alcohols comprising smaller proportions. $C_2$ Ethanol has more energy density than does $C_1$ methanol. Typically, the energy density increases with the increasing carbon content in the higher alcohols. The higher alcohols $C_3$-$C_8$ (propanol, butanol, pentanol, hexanol, heptanol and octanol) provide more energy density than do the lower alcohols $C_1$-$C_2$.

Traditionally, the use of ethanol as an additive to petroleum base-fuels has resulted in a blended fuel which displays a lower energy density (measured in Btu/lb or Btu/gal) than does petroleum-based fuel without ethanol. Thus, the miles per gallon which can be achieved by a typical internal combustion engine powered vehicle is slightly lower when using an ethanol and hydrocarbon-based fuel (such as gasoline) blend than when using fuel without ethanol. However, with the present invention, the use of higher alcohols $C_3$-$C_8$ increases the energy density of the alcohol mixture. Thus, less energy loss is incurred when using the mixed alcohols as a fuel additive. In fact, the mixed alcohols can contain higher alcohols such as $C_9$, $C_{10}$.

The use of $C_6$-$C_8$ alcohols, while preferred, is optional. Thus, the mixed alcohols blended into gasoline can contain $C_1$-$C_5$ alcohols only. Upon combustion, mixed $C_1$-$C_5$ alcohols in combination with gasoline produces lower emissions of hydrocarbons and carbon monoxide relative to gasoline-only type fuels. A typical mixture of mixed alcohols ($C_1$-$C_5$) is, by volume:

1-30% methanol 40-75% ethanol 10-20% propanol 4-10% butanol 1-8% pentanol.

The mixed alcohols ($C_1$-$C_5$ or $C_1$-$C_8$ or $C_1$-$C_{10}$) can be blended manually by providing the various components in the proper proportions. Alternatively, the mixed alcohols can be synthesized in large commercial quantities. For example, the mixed alcohols can be made by passing synthesis gas over a potassium-promoted $CoSMoS_2$ catalyst at about 1500 psig and 300 degrees C. This process is more fully described in U.S. Pat. Nos. 4,752,622 and 4,882,360.

The mixed alcohols can contain some slight impurities due to the manufacturing process. Such impurities include esters, water and trace amounts of hydrocarbons. These impurities can be removed if required by the particular application.

Note that the mixed alcohols are both water soluble and oil soluble and function as water solubilizers. Methanol has long been added to gasoline tanks to solubilize with condensate water. When there is too much water however, the methanol-bound water can phase-separate from the hydrocarbon-base fuel. This can cause engine problems such as engine stalling. An engine can tolerate some water in the fuel, so long as it is well mixed. The use of the higher alcohols ($C_3$-$C_8$ or $C_3$-$C_{10}$) serve to mitigate separation of the contaminant water in the fuel. The higher alcohols will solubilize condensate water much tighter than conventional, lower $C_1$-$C_2$ alcohols do.

The mixed alcohols can be blended into gasoline, jet or diesel fuels, as well as heating oil, bunker oil, petroleum coke or coal. Generally speaking, gasoline, jet and diesel fuels are primarily derived from crude oil and contain additives. Gasoline, jet fuel and diesel are all well known fuels. Jet fuel contains kerosene. Heating oil, grades 1 or 2, is used to heat homes or other structures. Lower distillate Bunker oil, grades A, B or C, is traditionally combusted in large ocean-going ships. Petroleum coke and coal are typically combusted in furnaces, kilns and boilers. Petroleum coke and coal also are used as process feedstocks for gasifiers.

The mixed alcohols can be blended with gasoline so as to make a blended fuel. The blended fuel can contain 1-99% by weight of mixed alcohols with the remainder being gasoline. Such a blended fuel features an enhanced octane. The mixed alcohols are a more effective octane enhancer than is either MTBE or ethanol for gasoline. Additionally, the higher alcohols feature a greater energy density than either ethanol or MTBE. The mixed alcohols are biodegradable in land and water environments. This is unlike MTBE, which persists and pollutes land and water environments. Mixed alcohols can be used as a direct replacement or substitute for MTBE in gasoline. Thus, when mixed alcohols are used in gasoline, MTBE need not be added to that gasoline.

In addition, the mixed alcohols can substitute for E-85 fuel blends (which are 85% grain ethanol and 15% gasoline). E-85 fuel blends are used in flex-equipped factory designed internal combustion engines, called Flex Fueled Vehicles (FFV's).

The gasoline is preferably unleaded gasoline, which is conventional and commercially available. Gasoline is a well-known fuel comprising mixtures of aromatics, olefins and paraffins. Gasoline may be known in some countries by other terms, such as petrol or benzene. The boiling points of these hydrocarbons is typically 77-437 degrees F. Gasoline may also include additives, such as detergents, anti-icing agents, demulsifiers, corrosion inhibitors, dyes, deposit modifiers and octane enhancers (such as tetraethyl lead or MMT). As discussed above, global gasoline supplies are preferably unleaded (that is, containing little or no tetraethyl lead or MMT).

There are several different blends of unleaded gasoline currently refined and sold throughout the world. These are conventional gasoline, winter oxygenated gasoline and reformulated gasoline. Conventional gasoline is formulated with a lower Reid Vapor Pressure (RVP) in order to evaporate more slowly in hot weather thereby reducing smog. Winter oxygenated and reformulated gasolines may contain MTBE or may contain ethanol to produce a cleaner burning fuel. Winter gasolines typically feature higher Reid Vapor Pressures (up to 12 psi or higher) to assist with cold starts. Summer gasolines typically feature 8 psi Reid Vapor Pressure ratings.

The mixed alcohols can be used as a substitute for MTBE and/or ethanol in gasoline, such as reformulated gasoline and/or winter oxygenated gasoline.

In addition, conventional commercial gasoline typically has an octane number between 87 and 90. So called regular gasoline has an octane number (R+M)/2 of about 87 when sold at sea level or 85 octane when sold at higher elevations, while premium gasoline has an octane number typically greater than 90. The octane number is a measure of the resistance of the gasoline to premature detonation in the engine. Premature detonation wastes the energy in the fuel and can harm the engine. An engine that knocks or pings during operation is experiencing premature detonation. Using a gasoline with a higher octane number typically lessens or eliminates the knocking or pinging problem.

The mixed alcohols enhance the octane number of the fuel. This is particularly advantageous for aviation gasoline. Aviation gasoline is typically gasoline having a higher octane number (100 or greater) than automotive gasoline. Tetraethyl or tetramethyl lead is added to gasoline in order to produce the higher octane number required for aviation gasoline. Tetraethyl lead used to be added to automotive gasoline in order to raise the octane number. However, the use of lead in gasoline has been all but eliminated in the United States, Canada and several developed countries, with the common exception of aviation gasoline. Thus, the use of mixed alcohols can enhance the octane number of gasoline in order to produce aviation gasoline, without the use of harmful, poisonous lead.

In a preferred embodiment having a somewhat lower Btu range, tests were conducted on the following mixture of mixed alcohols, by volume:

28.6% methanol 47.0% ethanol 14.4% n-propanol 3.7% n-butanol 2.5% n-pentanol 3.8% esters (I)

The esters were methyl acetate (1.9%) and ethyl acetate (1.9%). The oxygen mass concentration for the above mixed alcohols is 34%.

When 5% volume of mixed alcohols containing $C_1$-$C_5$ alcohols were blended with 85 octane heptane and iso-octane reference fuels, which contained no other oxygenate, the (R+M)/2 blending octane number of the mixed alcohols was measured as 109. It is believed that the blended octane number can exceed 135 under different blending conditions and volumetric concentrations. Test methods ASTM D 2699 and 2700 were used to determine octane number.

The Reid Vapor Pressure (RVP) of the mixed alcohols is low to mid-range. RVP is a measure of a fuel's propensity to vaporize or evaporate. The higher the RVP, the more vaporization. A lower RVP is preferred to prevent vapor lock and reduce evaporative emissions (such as summertime evaporation of fuel from fuel tanks). A higher RVP is preferred in cold seasons to improve cold starts of engines. Reformulated gasoline has an RVP of between 6.4-10.0 psi. The measured RVP of the mixed alcohols $C_1$-$C_5$ is 4.6 psi (using test method ATSM D 5191). The blending RVP's of MTBE and pure ethanol are 8-10 psi and 17-22 psi, respectively. Measured RVP's of mixed alcohols may differ from their blending RVP's. Some reformulated gasolines currently require 2% by weight of oxygen in the fuel. It is believed that the blending of the mixed alcohols into gasoline will not significantly raise the RVP of the blended gasoline. Experiments have shown that when greater volumes (such as 25% volumes) of mixed alcohols are blended into gasoline the RVP of gasoline remains essentially unchanged. 10% volumes of higher mixed alcohols may raise the RVP of gasoline upwards by 0.6 to 1 psi. Thus, the mixed alcohols can raise the oxygen content of the fuel without significantly raising the RVP. This, coupled with more energy density than competing oxygenates are two of the primary commercial strengths of higher mixed alcohols.

The volumetric energy content of the mixed alcohols ($C_1$-$C_5$) alone is lower than unoxygenated gasoline. However, the energy content of the mixed alcohols is greater than E-85. It is believed that by incorporating $C_6$-$C_8$ alcohols into the mixed alcohols, the energy density will grow even closer to that of gasoline. Thus, the use of mixed alcohols $C_1$-$C_8$ with gasoline will produce the desired oxygen content (and resulting emissions reduction) while avoiding an energy penalty. A vehicle using a 10% volume blend of mixed alcohols $C_1$-$C_8$ and gasoline will provide about the same miles per gallon as when combusting gasoline alone.

The use of mixed alcohols and gasoline reduces intake valve deposits (IVD), exhaust valve deposits (EVD) and combustion chamber deposits (CCD). As the concentration of mixed alcohols increases relative to gasoline, the carbon deposits further decrease. Furthermore, there is not a problem with hydrocarbon sludge or varnish buildup in the engine's fuel system when using mixed alcohols. Engine oil lubricants may need to be changed to a lubricant which is better adapted to acidic combustion products.

Emission characteristics will now be described. Emission characteristics were obtained by combusting two fuels separately in a 3.8L Buick LeSabre. The fuels were gasoline alone and a blend of 15% $C_1$-$C_5$ mixed alcohols (see (I) above) and 85% gasoline. The tests were performed in accordance with the U.S. Federal Test Procedure (FTP). The FTP refers to Code of Federal Regulations, Volume 40, "Protection of the Environment", herein incorporated by reference in its entirety. The engine was tuned to combust the gasoline alone. No adjustments were made to combust the blended fuel of mixed alcohols and gasoline.

A Clayton Model ECE-50 passenger dynamometer with a direct drive variable inertia flywheel system was used for testing. The inertia weight simulates equivalent weights of vehicles from 1000 pounds to 4875 pounds in 125 pound increments. The inertia weight and horsepower settings for the dynamometer were 3750 lb and 7.2 hp, respectively.

A positive displacement-type constant volume sampling system (CVS) was used to dilute the vehicle exhaust before collecting emission samples. A 10 inch diameter by 12 foot long stainless steel dilution tunnel was used with the CVS.

The vehicle hood was maintained fully open during all cycles, and was closed during the soak (turned off) periods. A cooling fan of 5,000 cfm was used in front of the test vehicle to provide air flow during all of the tests. During soaks, the fan was turned off.

For emission testing, the vehicles were operated over the Urban Dynamometer Driving Schedule (UDDS). The UDDS is the result of more than ten years of testing by various groups to translate the Los Angeles smog-producing driving conditions to dynamometer operations, and is a non-repetitive driving cycle covering 7.5 miles in 1372 seconds with an average speed of 19.7 mph. The maximum speed is 56.7 mph. An FTP consists of a cold start, 505 seconds, cold transient phase, followed immediately by an 867 seconds, stabilized phase. Following the stabilized phase, the vehicle was allowed to soak for ten minutes with the engine turned off before proceeding with a hot start, 505 seconds, hot transient phase to complete the test.

The emissions are mathematically weighted to represent the average of several 7.5 mile trips made from hot and cold starts. Exhaust emissions for the FTP cover the effects of vehicle and emission control system warmups as the vehicle is operated over the cycle. The stabilized phase produces emissions from a fully warmed up or stabilized vehicle and an emission control system, "Hot start" or "hot transient" phase emissions result when the vehicle and emission control systems have stabilized during operations, and are then soaked (turned off) for ten minutes.

Several of the regulated emissions (HC, CO) were reduced when the engine used the blend of mixed alcohols and gasoline. For gasoline alone, the total hydrocarbon emissions (THC) were 0.058-0.059 grams (g) per mile, while for the blend of mixed alcohols and gasoline, THC emissions were 0.032-0.070 grams per mile. Some of the THC emissions comprised methane. The non-methane hydrocarbon (NMHC) emissions were 0.049-0.054 grams per mile for gasoline alone and 0.030-0.067 grams per mile for the blend of mixed alcohols and gasoline. The CO emissions were 0.573-0.703 grams per mile for gasoline alone and 0.285-0.529 grams per mile for the blend of mixed alcohols and gasoline. The NOx emissions were 0.052-0.058 grams per mile for gasoline and 0.059-0.063 grams per mile for the blend of mixed alcohols and gasoline. Thus, the use of mixed alcohol significantly decreased carbon monoxide emissions, decreased hydrocarbon emissions and only slightly increased NOx emissions.

The use of mixed alcohols and gasoline slightly increased emissions of formaldehyde and acetaldehyde relative to gasoline alone. The formaldehyde emissions were 0.781-0.859 milligrams (mg) per mile for gasoline alone and 0.900-1.415 mg per mile for mixed alcohols and gasoline. The acetaldehyde emissions were 0.126-0.294 mg per mile for gasoline alone and 0.244-0.427 mg per mile for mixed alcohols and gasoline. It is believed that the presence of esters in the mixed alcohols contributed to the increase in formaldehyde and acetaldehyde. The esters can be removed from the mixed alcohols to reduce these emissions.

The mixed alcohols can be blended with jet fuel so as to make a blended fuel. Jet fuel is primarily kerosene with additives. The blended fuel can contain 1-30% by volume of the mixed alcohols, with the remainder being jet fuel. An attractive aspect of the mixed alcohols is that they solubilize condensate water which develops in the head space above jet fuel while pilots are flying at extra cold high altitudes.

The mixed alcohols can be blended with diesel so as to make a blended fuel. The blended fuel can contain 1-30% by volume of mixed alcohols with the remainder being diesel. Diesel is a well-known fuel.

A mixed alcohols-diesel fuel blend containing 10% ($C_1$-$C_5$) mixed alcohols (see (I) above) and 90% diesel fuel was tested. The results were as follows:

| Test Parameter | Test Method | Result |
|---|---|---|
| Specific Gravity | ASTM D 4052 | 0.7514 |
| Carbon/Hydrogen (wt %) | ASTM D 5291 | 80.86/12.92 |
| Cetane Number | ASTM D 613 | 43.4 |
| Sulfur Content | ASTM D 2622 | 354 PPM |
| Oxygen Content | ASTM D 5599 | 1.16 wt % |
| Heat of Combustion | ASTM D 240 | Btu/lb |
| Gross | | 19079.9 |
| Net | | 17933.1 |
| HFRR | ASTM D6079 | 205 microns |
| Boiling Distribution | ASTM D86 | ° F. |
| IBP | | 147.2 |
| 5% | | 175.3 |
| 10% | | 340.0 |
| 15% | | 404.1 |
| 20% | | 423.5 |
| 30% | | 445.7 |
| 40% | | 469.9 |
| 50% | | 490.9 |
| 60% | | 512.2 |
| 70% | | 534.7 |
| 80% | | 559.1 |
| 90% | | 590.9 |
| 95% | | 615.6 |

-continued

| Test Parameter | Test Method | Result |
|---|---|---|
| FBP | | 631.9 |
| Recovered % | | 98.3 |
| Loss % | | 0.5 |
| Residue % | | 1.2 |

The use of mixed alcohols in diesel will reduce the particulates produced during combustion. In addition, it is believed that regulated emissions (hydrocarbons, carbon monoxide and nitrogen oxides) will be reduced.

In order to better blend the water soluble mixed alcohols with diesel, a surfactant binder can be used. One such commercially available surfactant that is expected to work well is Octimax 4900 available from Octel Starion.

The mixed alcohols can be volumetrically blended with diesel as follows: 50% mixed alcohols, 50% diesel. A diesel engine operating on such a fuel blend would likely need a one-time adjustment of its fuel injectors to achieve the proper air-fuel mixture. Fleet vehicle applications could benefit in particular from such a fuel blend.

The blending of the mixed alcohols into gasoline or diesel can occur in a variety of manners. The mixed alcohols can be splash blended into tanker trucks or rail cars. The movement of the tankers during transport will fully blend or mix the mixed alcohols into the gasoline or diesel. Another way of blending is to add the mixed alcohols to the fuel tank of a vehicle which is to combust the fuel. Again, the movement of the tank as the vehicle moves is sufficient to mix the fuel with the mixed alcohols. Still another way is to meter the mixed alcohols into a tank with the fuel.

The mixed alcohols can be used as a neat fuel in internal combustion engines, furnaces and in boilers. That is to say, the mixed alcohols need not be blended with other fuels for combustion. The air/fuel ratios of engines, furnaces or boilers may need to be tuned to operate on a mixture of alcohols alone as a neat fuel. The octane number of the neat mixed alcohol fuel is typically between 90 and 138 depending upon its $C_1$-$C_5$ or $C_1$-$C_8$ or $C_1$-$C_{10}$ formulation. The blending characteristics of the mixed alcohols are not linear.

Mixed alcohol's higher octane is particularly advantageous for aviation gasolines, which require an octane number from 100 to 120 or greater. In fact, an experimental aircraft made a transatlantic flight using ethanol alone. It is believed that the use of the mixed alcohols of the present invention, with its higher energy density, will become a superior aircraft fuel over ethanol because of the increased octane, energy density (Btu's per pound) and water-solubilizing characteristics.

Several tests were conducted on the neat fuel mixed alcohols (see (I) above) to determine octane number. It was determined that the neat mixed alcohols would not ping in research engines designed to measure ping or pre-ignition. The octane of the neat mixed alcohols exceeded the upper threshold of these research engines.

In order to attempt to estimate the octane of the mixed alcohols, a test was conducted with the $C_1$-$C_5$ mixed alcohols blended at 5% volume with 85 octane reference fuel comprised of heptane and iso-octane. The research octane was measured at 118.9 using test method ASTM D 2699 and the motor octane was measured at 98.2 using test method ASTM D 2700. The calculated blended octane number (R+M)/2 was 108.6. Thus, 108.6 is a particular blending octane rating.

To further delineate an octane rating of the neat mixed alcohols of (I), a 50/50 mixture of iso-octane and heptane was used as a reference fuel reagent source with a known reference octane of 50. Then, the $C_1$-$C_5$ mixed alcohols were blended at 50% volume with iso-octane/heptane. The research engines needed to be rejetted before a ping could be detected in order to accommodate the measuring of an octane greater than 110. After rejetting, research octane was calculated at 148.8, motor octane was calculated at 126.8 and the (R&M)/2 blending octane number was 137.8, using the test methods described above.

Experiments demonstrated that neat higher mixed alcohols $C_1$-$C_5$ formula provided a stand-alone octane above 130. The blending characteristics of the mixed alcohols are not linear. Therefore, the blending octane numbers provided by the $C_1$-$C_5$ or $C_1$-$C_8$ or $C_1$-$C_{10}$ mixed alcohols will depend solely upon what fuel products they are blended into and at what volume percentages.

Reid Vapor Pressure was measured at 4.6 psi using test method ASTM D 5191 for $C_1$-$C_5$ mixed alcohols. This mid-range Reid Vapor Pressure is particularly desired in warm climates where volatile organic compounds (VOC's) from evaporation of fuels is a source of pollution. The Reid Vapor Pressure of $C_1$-$C_5$ or $C_1$-$C_8$ higher mixed alcohols will typically be between 2.35-5.0 psi.

The heat of combustion of the $C_1$-$C_5$ neat fuel mixed alcohols was measured using test method ASTM D 240. The gross heat of combustion was 12,235 BTU/lb. and the net was 11,061 BTU/lb. It is believed that this is below the heat of combustion of gasoline. The use of $C_6$-$C_8$ alcohols in the neat fuel mixed alcohols have been experimentally demonstrated to further increase the heat of combustion to 90,400 Btu's per gallon, nearer to that of gasoline at 113,000 Btu's.

The drivability index was measured at 949 using test method ASTM D 86. It is preferred if the drivability index does not exceed 1250. Thus, the neat fuel mixed alcohols drivability index was well below the maximum amount.

A corrosion test was performed on the neat fuel mixed alcohols to determine compatibility with types of metals that might be used in an internal combustion engine. The corrosion test was conducted using test method ASTM D 4636. Iron, copper, aluminum, magnesium and cadmium showed zero milligrams of loss. This indicates that the neat fuel mixed alcohol is as good as gasoline or diesel or kerosene-based jet fuel in being compatible with engine components.

Other engine components are elastomers, which are used in seals, hoses, gaskets, etc. Internal combustion engines are typically equipped with fluorinated elastomers in the gaskets, hoses and seals which are better suited to alcohol type fuels than non-fluorinated elastomers. The test method for fluorinated elastomer compatibility was ASTM D 471. After 240 hours, run at 50 degrees C., the volume change (percentage) was +25.81-26.01; hardness change (in points) was −22--23; the tensile strength change (percentage) was −41.40--45.93; and the elongation change (percentage) was −0.5763--0.6937.

The mixed alcohols can also be used as a near-neat fuel in Flex Fueled Vehicles (FFV's). The blend could be 95% mixed alcohols and 5% gasoline, by volume. The 5% gasoline increases the alcohol's Reid Vapor Pressure for cold temperature starts.

Still another formulation of the mixed alcohols is, by weight:

10-30% methanol 40-60% ethanol 10-20% propanol 3-8% butanol 1-5% pentanol

3% hexanol 0.3% heptanol 0.1% octanol

A particular embodiment of the mixed alcohols is, by weight:

17.1% methanol 49.0% ethanol 17.3% propanol 7.0% butanol 5.1% pentanol 3.2% hexanol 0.3% heptanol 0.1% octanol.

The above mixed alcohols can be used in gasoline, in diesel or neat as a substitute fuel.

In addition, the mixed alcohol as discussed above can be used in heating oil, grades 1 or 2. The blended fuel can contain 1-30% by volume of the mixed alcohols, with the remainder being heating oil. The fuel is used for heating. For example, the fuel is combusted to heat homes or other structures.

Heating oil is quite similar to diesel with different additives, such as water solubilizers, bacterial inhibitors and additives which reduce deposit formation. The heating oil fuel with the mixed alcohols can contain these additives or in the alternative, the mixed alcohols may take the place of these additives. Heating oil is a middle distillate and contains paraffins (alkanes) cycloparaffins (cycloalkanes), aromatives and olefins from about $C_9$-$C_{20}$.

The mixed alcohols discussed above can also be used in bunker oil, grades A, B or C. The blended fuel can contain 1-30% by volume of the mixed alcohols, with the remainder being bunker oil. The fuel is commonly used in marine vessels and is combusted to power the power plants. The vessel derives propulsion and electricity generation from combusting the fuel.

Bunker oil is the most thick and sticky of the lower distillate residual fuels just ahead of the remaining portions which are utilized to produce asphalt. Bunker A and B oils are lighter than Bunker C. Bunker C is produced by blending the oil remaining after the refining process with lighter oil.

When blending the mixed alcohols with either heating oil or bunker oil, a mixing agent or surfactant binder can be used to prevent separation of the alcohols from the oil. One such surfactant is Octimax 4900, discussed above. Other commercial surfactant binders are also available. No surfactant binders are necessary when mixed alcohols are blended into gasoline or jet fuel.

Use of mixed alcohols blended with heating oil or bunker oil serves to mitigate air, water and land pollution.

The mixed alcohols can also be blended with finely ground petroleum coke or coal solid particles. The result is a coke-alcohol slurry or coal-alcohol slurry which can be pipelined, stored in tanks, or transported by rail, tanker ship or barge. Typically the coke or coal particles are less than or equal to 200 microns in size (for example, the particles can pass through a 100 mesh screen). The coke or coal is preferably ground in a mixed alcohol bath. The finer the solid carbons are ground the better that the alcohols will beneficiate and clean both coke or coal solids. Suspension properties of either coke-alcohol or coal-alcohol in a transportation or storage slurry of mixed alcohols are further increased by a finer grind of the solid particles.

Petroleum coke is a by-product of the oil refining process. Delayed coking, the most widely used process, uses heavy residual oil as a feedstock. The coal can be bituminous, anthracite or lignite variety.

The amount of coke or coal particles in the slurry is 50%-75% by weight. The remaining 50%-25% by weight are the mixed alcohols. A preferred slurry is 65% ground coke or coal and 35% mixed alcohols by weight.

Both the coke-alcohol and coal-alcohol fuels encompass various types of stable suspensions of any rank of coke or coal or mixed alcohols as well as the solids and liquid fuels derived from them.

The invention of the use of mixed alcohol fuel as a blend stock to hydrocarbons improves and enriches the properties of both petroleum coke and coal when combusted or gasified. It serves as a highly efficient freeze-proof media to transport ground coke or coal as a slurry with mixed alcohols by pipeline, rail, barge, tanker or ship. At the destination, heat from the waste or other source separates the coke or coal from all, one, or a sequence of the mixed alcohols as desired for any number of conceived combustion or gasification applications. The ground coke or coal, which is highly activated and beneficiated (such as by diminishing water contamination and driving off nitrogen and sulfurs) in the processing with mixed alcohols, can be combusted in new or retrofitted furnaces, kilns or boilers but preferably in special combined cycle operations. In combined cycles, the fuel mixed alcohols in total or any of its components, singly or combined, are combusted in a gas turbine generator and the separated pulverized coke or coal fires a combustion boiler supplying power to a steam turbine electrical generator.

Use of the coke-alcohol or coal-alcohol fuel provides higher combustion efficiency with lower environmental impact per unit of power output. Furthermore, in contrast to a transportation complex of coal-water slurries, the coke-alcohol or coal-alcohol fuel comprised of its uniquely invented mixed alcohol formula transfers only fuel and conserves water at the origin. The coke-alcohol and coal-alcohol fuel both provide a higher Btu content with relatively less sulfur, nitrogen and particulate matter. Use of mixed alcohols blended with either coke or coal serves to mitigate air, water and land pollution.

The beneficiated petroleum coke or coal can be separated from the mixed alcohols as desired for applications for gasification to synthesis gas or for combustion in furnaces, kilns or boilers.

The mixed alcohols would be separated from solid coke or coal through screening or centrifuge. The remaining percentage of mixed alcohols present in the solid fuel would increase its combustion efficiency and also reduce harmful emissions. The coal-alcohol or coke-alcohol fuels may be stored for long periods of time without the settling or floating of solid particles thus the fuel will easily flow through positive displacement pumps.

The foregoing disclosures and examples are merely illustrative of the principles of this invention and are not to be interpreted in a limiting sense.

The invention claimed is:

1. A fuel for use in heating furnaces or boilers, comprising:

a) heating oil;

b) mixed alcohols comprising by volume:

1-30% methanol 40-75% ethanol 10-20% propanol 3-10% butanol 1-8% pentanol.

2. The heating fuel of claim 1 wherein the mixed alcohols by volume, further comprises:

1-6% hexanol 0.1-6% heptanol 0.1-6% octanol.

3. The heating fuel of claim 2 wherein the mixed alcohols further comprise by volume:

0.1-3% nananol 0.1-3% decanol.

4. A fuel for use in heating furnaces and boilers, comprising:

a) bunker oil;

b) mixed alcohols comprising by volume:

1-30% methanol 40-75% ethanol 10-20% propanol 3-10% butanol 1-8% pentanol.

5. The fuel of claim 4 wherein the mixture of alcohols by volume, further comprises:

1-6% hexanol 0.1-6% heptanol 0.1-6% octanol.

6. The fuel of claim 5 wherein the mixed alcohols further comprise by volume:

0.1-3% nananol 0.1-3% decanol.

7. A fuel for a furnace, kiln, boiler, or gasifier comprising:

a) coke particles;

b) mixed alcohols comprising by volume:

1-30% methanol 40-75% ethanol 10-20% propanol 3-10% butanol 1-8% pentanol.

8. The fuel of claim 7 wherein the mixture of alcohols by volume, further comprises:

1-6% hexanol 0.1-6% heptanol 0.1-6% octanol.

9. The fuel of claim 8 wherein the mixed alcohols further comprise by volume:

0.1-3% nananol 0.1-3% decanol.

10. A fuel for a furnace, kiln, boiler, or gasifier comprising:

a) coal particles;

b) mixed alcohols comprising by volume:

1-30% methanol 40-75% ethanol 10-20% propanol 3-10% butanol 1-8% pentanol.

11. The fuel of claim 10 wherein the mixture of alcohols by volume, further comprises:

1-6% hexanol 0.1-6% heptanol 0.1-6% octanol.

12. The fuel of claim 11 wherein the mixed alcohols further comprise by volume:

0.1-3% nananol 0.1-3% decanol.

* * * * *